United States Patent [19]

Sucht et al.

[11] Patent Number: 5,011,432

[45] Date of Patent: Apr. 30, 1991

[54] COAXIAL CABLE CONNECTOR

[75] Inventors: Gayle A. Sucht, Mountain View; John S. Mattis, Sunnyvale, both of Calif.

[73] Assignee: Raychem Corporation, Menlo Park, Calif.

[21] Appl. No.: 574,413

[22] Filed: Aug. 28, 1990

Related U.S. Application Data

[63] Continuation of Ser. No. 485,798, Feb. 22, 1990, Pat. No. 4,952,174, which is a continuation of Ser. No. 351,738, May 15, 1989, abandoned.

[51] Int. Cl.[5] ..... H01R 13/00

[52] U.S. Cl. ..... 439/584

[58] Field of Search ..... 439/578–585

[56] References Cited

U.S. PATENT DOCUMENTS

| | | | |
|---|---|---|---|
| 2,449,983 | 9/1948 | Devol | 174/88 |
| 3,206,540 | 9/1965 | Cohen | 174/89 |
| 3,209,287 | 9/1965 | Oxner et al. | 333/34 |
| 3,846,738 | 11/1974 | Nepovim | 339/177 R |
| 3,847,463 | 11/1974 | Hayward et al. | 339/8.177 |
| 3,854,789 | 12/1974 | Kaplan | 339/177 R |
| 4,346,958 | 8/1982 | Blanchard | 339/177 R |
| 4,400,050 | 8/1983 | Hayward | 339/177 R |
| 4,575,274 | 3/1986 | Hayward | 403/2 |
| 4,583,811 | 4/1986 | McMills | 339/177 R |
| 4,696,532 | 9/1987 | Mattis | 439/863 |
| 4,854,893 | 8/1989 | Morris | 439/878 |
| 4,952,174 | 8/1990 | Sucht et al. | 439/584 |

FOREIGN PATENT DOCUMENTS

| | | |
|---|---|---|
| 0134358 | 8/1988 | European Pat. Off. . |
| 2425063 | 12/1975 | Fed. Rep. of Germany . |
| 1346884 | 2/1974 | United Kingdom . |
| 2087666A | 5/1982 | United Kingdom . |

OTHER PUBLICATIONS

Product Data Sheet for Quantum Reach Coaxial Cable.
Product Data Sheet for Parameter III Coaxial Cable.
Holland Electronics Corp. Installation Instructions for T-Lock Series F Connectors.
Drop Shop Installation Instructions for T-Lock Series F Connectors.

*Primary Examiner*—Joseph H. McGlynn
*Attorney, Agent, or Firm*—A. Stephen Zavell; Herbert G. Burkard

[57] ABSTRACT

A coaxial cable connector is provided for installation and use with a prepared end of a coaxial cable. The connector comprises a body and nut threadably tightenable to the body. The body includes a center pin chuck for engaging the center conductor of the cable when the nut assembly is tightened to the body. The nut defines an interior space including a mandrel assembly which is freely rotatable within the interior space until the nut is tightened to the body. The mandrel assembly includes an insulator cone for guiding the center conductor; it includes a clampling arrangement for engaging and clamping the center pin chuck as the nut is tightened to the body. The assembly further includes a mandrel which is slideably mounted under the cable outer metal jacket in a space provided after removal of a portion of the dielectric core incident to preparation of the cable end. A ferrule is slidably mounted over the outer jacket and the ferrule includes collet fingers disposed over a portion of the mandrel. The mandrel includes a ferrule collet closure for closing the collet fingers of the ferrule to cause them to compress the outer metal jacket against the portion of the mandrel as the nut is tightened to the body of the connector during installation of the connector to the prepared cable end.

21 Claims, 3 Drawing Sheets

COAXIAL CABLE CONNECTOR

This application is a continuation of copending application Ser. No. 07/485,798 filed Feb, 22, 1990, now U.S. Pat. No. 4,952,174 which is a file-wrapper continuation of Ser. No. 07/351,738 filed May 15, 1989, now abandoned.

FIELD OF THE INVENTION

The present invention relates to cable connectors. More particularly, the present invention relates to a coaxial cable connector having improved mechanical and electrical properties for mating to the prepared end of a coaxial cable having a central conductor, dielectric material such as foam surrounding the central conductor, a metal outer conductor which also serves to jacket and contain the dielectric, and a non-conductive outer protective sheathing surrounding the metal outer jacket.

BACKGROUND OF THE INVENTION

Semi-rigid, low loss coaxial cables enjoy widespread use in cable television distribution systems, for example. Such cables typically include a solid central conductor which is surrounded by a core of low loss, high dielectric characteristic material, usually a plastic foam. A metal, e.g. aluminum, cylindrical outer jacket providing a signal return path concentrically surrounds the central conductor and contains the dielectric material. The cable is protected by a non-conductive sheathing which surrounds the outer metal jacket and prevents moisture from reaching the jacket or the interior of the cable.

In order for the cable to be used effectively, a connector is typically provided for attachment at an end thereof. Once installed, the connector may then serve as an interface between the cable and distribution amplifiers or panels; or, alternatively, the connector may be double-ended and serve as an appliance to splice two cable ends together.

The ends of television distribution semi-rigid coaxial cables are typically prepared by the craftsperson/installer in order to receive the cable connector. Such preparation typically comprises removal of the outer sheathing and metal jacket for about one half inch, and removal with a standard coring tool of the foam core between the jacket and the central conductor for a distance of about one to two inches in order to receive a conductive mandrel against which the outer jacket and sheathing are clamped by the connector. In using connectors the outer plastic sheathing material is removed for some longitudinal distance of cable at the end, so that a split ring ferrule may directly engage and clamp the outer metal jacket to the mandrel.

Cable connectors of the type contemplated by the prior art have usually comprised either three piece or two piece assemblies. A representative three piece cable connector is depicted in FIG. 1 of the Blanchard U.S. Pat. No. 4,346,958, whereas a representative two piece cable connector is depicted in FIGS. 2–4 thereof. Another representative two piece cable connector is depicted in U.S. Pat. No. 4,583,811 which is commmonly assigned with the present patent, the disclosure of which is hereby incorporated by reference.

Two piece cable connectors typically comprise a body which includes a cable engagement mechanism or structure for gripping the central conductor and for connecting to the outer metal jacket of the cable and an interface mechanism or structure for enabling an electrical connection to be made to the connector at an interface, i.e. a jack or junction of associated equipment. An outer nut is then threaded over the body, and compressively engages the cable to accomplish a mechanical attachment thereto, and also an electrical connection to the outer metal jacket and one or more environmental seals between the sheathing and the nut and body of the connector. The process of tightening the nut over the body of the connector may have the consequence of tightening the grip on the central conductor, as was the case in the referenced U.S. Pat. No. 4,583,811. And, when the nut is tightened, a split ring or fingered ferrule becomes compressed and forces the sheathing and outer metal jacket to contact and bear against the mandrel of the connector.

While prior art connector designs have assumed a wide variety of shapes and employed myriad principles, fundamentally, a cable connector must provide positive and secure mechanical and electrical connection. In order to work reliably over extended time periods, it must also achieve an effective, moisture-tight seal with the cable and the ambient in order to prevent intrusion of moisture. Even if an effective electrical connection is obtained at the central conductor and at the outer metal jacket, EMI requirements and regulations insist that radio frequency energies not be able to leak or escape to the ambient at the situs of the connector and cause potential interference with other communications services or appliances. Finally, the cable connector should be easy to install without special skills or tooling and without requiring application of significant tightening torques. Providing a cable connector which satisfies all of the foregoing requirements has proven problematic within the connector art.

SUMMARY OF THE INVENTION WITH OBJECTS

A general object of the present invention is to provide a cable connector which overcomes limitations and drawbacks of prior art cable connectors.

A more specific object of the present invention is to provide an improved cable connector which may be more easily and more reliably installed by the craftsperson/installer in accordance with general CATV cabling practices, for example, without need for special training or tooling.

Yet another specific object of the present invention is to provide an improved cable connector which provides more effective mechanical and electrical sealing characteristics against the ambient.

One more specific object of the present invention is to provide an improved cable connector which remains securely fastened to the cable and which provides reliable and positive electrical and mechanical connections throughout months and years of service in an outdoor ambient environment.

In accordance with the principles of the present invention, a coaxial cable connector is provided for installation and and use with a prepared end of a coaxial cable. The cable includes a center conductor, a dielectric core disposed axially about the center conductor, an outer metal jacket concentric with the center conductor and spaced therefrom by the dielectric core, and an outer protective sheathing surrounding the outer metal jacket. The connector comprises a body and a nut threadably tightenable to the body. The body includes a center pin chuck for engaging the center conductor of the cable when the nut assembly is tightened to the body. The nut defines an interior space including a mandrel assembly freely rotatable within the interior space until the nut is tightened to the body.

The mandrel assembly includes an insulator cone for guiding the center conductor; it includes a clamping arrangement for engaging and clamping the center pin chuck as the nut is tightened to the body. The assembly further includes a mandrel which is slideably mounted under the cable outer metal jacket in a space provided after removal of a portion of the dielectric core incident to preparation of the cable end. A ferrule is slidably mounted over the outer jacket and the ferrule includes collet fingers disposed over a portion of the mandrel. The mandrel includes a ferrule collet closure for closing the collet fingers of the ferrule to cause them to compress the outer metal jacket against the portion of the mandrel as the nut is tightened to the body of the connector during installation of the connector to the prepared cable end.

In one aspect of the present invention the outer metal jacket, the insulator cone, the mandrel, and the ferrule are substantially cylindrical and are aligned along a common longitudinal axis when the prepared cable end is inserted into the mandrel assembly of the nut, and the collet closure defines a converging inside conical closure surface which forces the collet fingers of the ferrule radially toward the longitudinal axis so as to bite into the outer metal jacket as the nut is tightened to the body. Advantageously, the inner surface of the collet closure has a relatively shallow angle, i.e. less than 45 degrees, preferably about 10 to about 30 degrees and most preferably about 15±5 degrees, enabling tightening of the assembly with relatively low torque.

In another aspect of the present invention, a body-to-nut seal is provided for effectuating an environmental seal when the nut is tightened to the body during installation of the connector at the cable end.

In a further aspect of the present invention, a connector-to-cable seal is provided for effectuating an environmental seal between the outer protective sheathing of the cable at the prepared end and the nut when it is tightened to the body during installation of the connector.

In one more aspect of the present invention, the connector-to-cable seal comprises a sacrificially or permanently deformable elastomeric material disposed and compressed between an interior face of the nut and the ferrule as the nut is tighteded to the body during installation.

In a still further aspect of the present invention, the mandrel includes a spline region directly underlying the connector to cable seal and causes the outer metal jacket of the cable to engage the spline region to prevent relative rotation of the cable and the connector after the nut has been tightened to the body.

In one more aspect of the present invention, the body further includes a connector pin integrally connected, e.g. press fit, welded or unitarily formed, to the center pin chuck and a connection nipple connected to the outer metal jacket after the nut has been connected to the body. The connector pin and connection nipple thereby enable the cable connector to provide electrical connection to and from the cable.

In a further advantageous aspect of the present invention, the mandrel, ferrule, and elastomeric sealing material arrangement enables secure connections to be made to semi-rigid coaxial cables having outer meal jackets which are quite thin, e.g. less than about 0.020 inch thick.

These and other objects, advantages, aspects and features of the present invention will be more fully understood and appreciated upon consideration of the following detailed description of a preferred embodiment, presented in conjunction with the accompanying drawings.

DETAILED DESCRIPTION OF A PREFERRED EMBODIMENT

Figure 1:
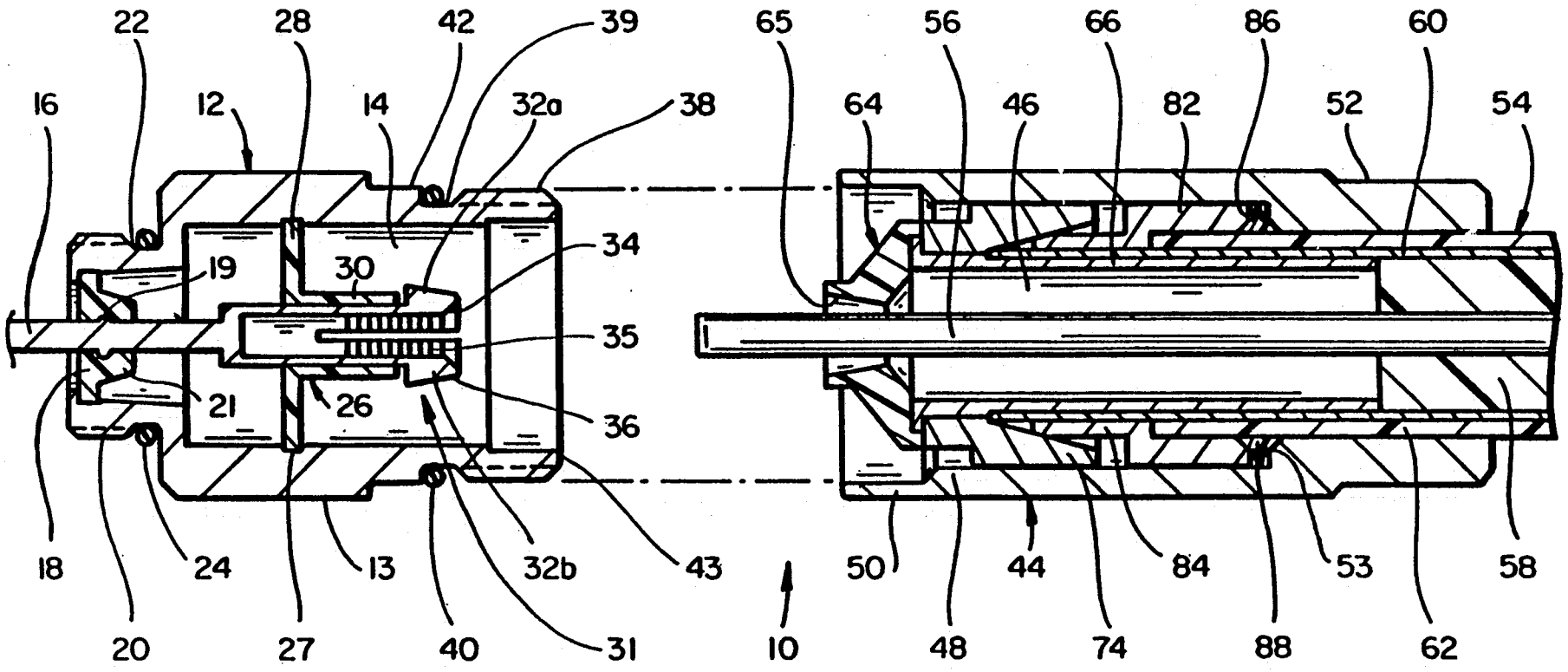
FIG. 1 is a cross sectional view in elevation of a two-part connector incorporating the principles of the present invention with the body part shown separatd from the nut part, and with a sectioned end portion of a cable installed in the nut part of the connector.
Figure 2:
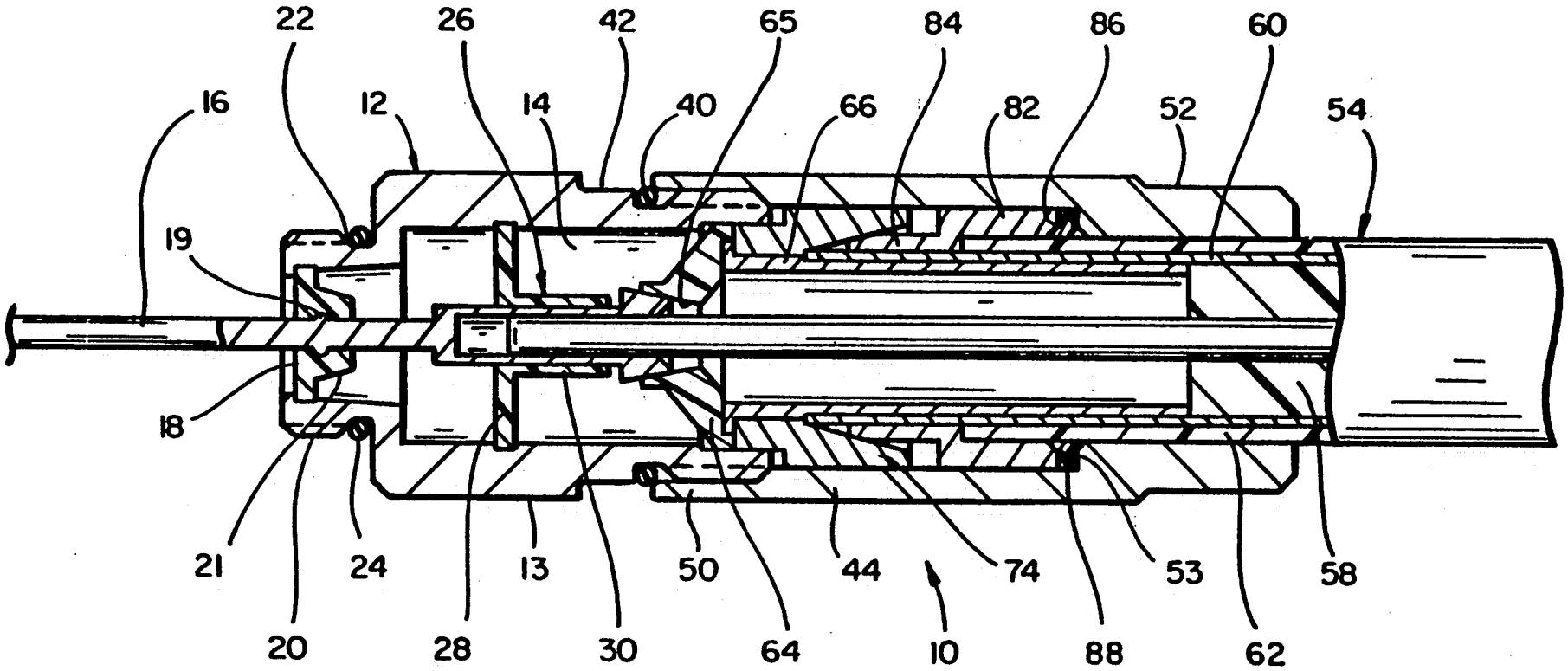
FIG. 2 is a cross sectional view in elevation of the FIG. 1 connector in which the nut part has been threaded over the body part, but not tightened to a fully tightened position.

With reference to FIGS. 1 and 2, a cable connector 10 in accordance with principles of the present invention includes a generally cylindrical body 12 which is slightly larger in diameter than the cable with which the connector 10 is associated. The body 12 defines a holloow cylindrical interior space, generally designated by the reference numeral 14. A center pin 16 is radially centered and supported within the interior space 14 by a pin support 18 which is press-fit over the pin and into an end opening defined through the body 12. A small flange 19 extends outwardly from the pin 16 and engages a mating recess within a shaft portion 21 of the pin support 18, thereby to align the center pin 16 axially relative to the body 12. A threaded nipple portion 20 of the body 12, in combination with the center pin 16, enable the connector 12 to be attached in electrical connection to a mating interface receptacle of a distribution panel, amplifier, or the like, typically within a cable television distribution system with which the connector 10 is intended for primary application and use. An annular groove 22 located directly behind the threaded nipple portion 20, provides a seat for an O-ring 24 which enables the connector body 12 to be environmentally sealed with respect to the mating receptacle (not shown).

A center pin retainer 26 includes a flat disk portion 28 and a cylindrical tube portion 30. The outer periphery of the disk portion 28 of the retainer 26 is positioned in the interior space 14 of the body 12 by seating within a very shallow annular groove or recess 27 formed on the inside surface of the body 12.

A center conductor chuck 31 for gripping a center conductor 56 of the cable is formed as a collet with four-quadrant tines 32*a*, 32*b*, 32*c* and 32*d* (only the tines 32*a* and 32*b* are shown in FIGS. 1 and 2). The collet chuck 31 may be formed to difine more tines 32 or fewer tines 32. A collet chuck 31 with two tines would effectively grip the center conductor 56 of the cable. The tines 32 define a chamfer 34 which serves as a guide for the center conductor 56 of the cable end 54 with which the connector 10 is associated. Transverse projections or splines 35 on the inside of the tines 32 bite into the outer surface of the center conductor 56 and thereby provide a secure mechanical attachment and a reliable electrical connection. The tube portion 30 of the center pin retainer 26 acts as a resilient spring which limits the degree of freedom of each tine 32, so that the chuck 31 is not damaged by insertion of a bent center wire 56 at the cable end 54.

The tines 32 collectively define a bevelled or ramped outer edge 36 which cooperates with a mating inside tapered surface 65 of a cone 64 of the two part connector 10. A threaded outer end region 38 of the body adjacent to the open end of the axially centered chuck 31 enables mating threads 48 of the nut 44 to be threaded onto the body 12 and the nut 44 tightened against the body 12. An annular groove 39 defined in the outer surface of trhe body 12 inside of the threads 38 provides a well for an O-Ring seal 40 which enables an outer flange region 50 of the nut 44 to become environmentally sealed to the body 12 when the nut 44 is tightened sufficiently so that the flange 50 moves over and past the groove 39 and O-ring seal 40 into an annular region 42 of the body 12.

The connector assembly 10 is intended primarily for use with a coaxial cable having a prepared end 54 so as to expose a center conductor 56 relative to a foam dielectric 58, outer metal jacket 60 and exterior protective sheathing 62. The end 54 may be prepared with a special tool, or a craftsperson may carefully remove the exterior protective sheathing 62, outer metal jacket 60 and foam dielectric 58 portions with sharp knife.

The connector assembly 10 will work quite satisfactorily with a wide range of semi-rigid coaxial cables having aluminum, copper or other metal alloy outer metal jackets. However, the assembly 10 is particularly useful with respect to cables having a very thin outer aluminum jacket, having a thickness less than e.g. twenty thousandths of an inch. One cable having this characteristic with which the assembly 10 is most satisfactorily used is the Quantum Reach (tm) QR series cable product made by Comm/Scope Inc.

The nut 44 of the connector 10 defines a generally cylindrical interior space 46. An exterior portion 52 of the generally cylinderical nut 44 defines flat surfaces arranged as a hexagon about a longitudinal central axis of the body and nut, and a portion 13 of the generally cylindrical body 12 also defines a hexagon. These hex formations enable the nut 44 to be tightened onto the body 12 by suitable wrenches by the craftsperson/installer. While hexagonal formations are presently preferred as standard within the CATV industry, any other suitable tightened tool engagement surface formation may be defined in the regions 13 and 52.

Figure 3:
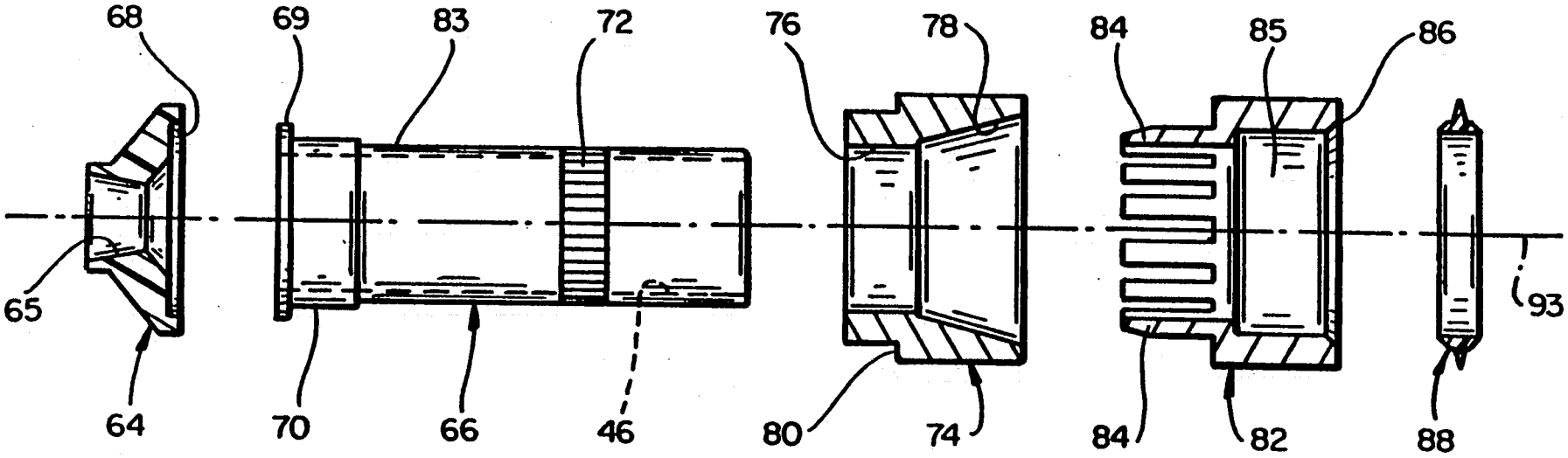
FIG. 3 is an exploded view in elevation and partial section of structural elements within the nut part of the two-part connector of FIG. 1.

A freely rotatable structure is formed within the interior space 46 of the nut 44. The structure, whose component parts are shown in exploded view along a central axis 93 in FIG. 3, includes a cone 64, a cylindrical mandrel 66 attached to the cone 64, a mandrel shell 74 fitted over the mandrel 66 and a tined ferrule 82 adapted to slide over the cylindrical shank of the mandrel 66. A sacrificial, permanently deformable seal ring 88 is disposed within the interior 46 to abut between a thickened inside portion 53 of the nut 44 and an outer end 86 of the ferrule 82.

The cone 64 is formed of a suitable high dielectric insulator material. The material of the cone 64 is of sufficient hardness so that when the inside tapered portion 66 engages the bevelled outer surfaces 36 of the tines 32 as the nut 44 is tightened onto the body 12, the splines 35 are circumferentially compressed and bite into the center conductor 56 of the prepared cable end 54 to achieve a positive mechanical engagement and electrical connction therewith. An annular recess portion 68 at the rear of the cone 64 is sized to receive an end flange 69 of the mandrel 66 in a press-fit, interference engagement. Optionally, the cone 64 may be loosely located within the body 12 in front of the central conductor chuck 31 prior to tightening, but the engagement is the same regardless of the manner of placement of the cone 64 within the body.

The mandrel 66 is formed as an elongated rigid metal sleeve, and it defines a raised shoulder region 70 just behind the end flange 69 thereof. This shoulder region 70 is sized to receive a cylindrical portion 76 of the mandrel shell 74 in close fitting engagement, e.g. a tight friction fit. Optionally, the mandrel 66 and its shell 74 may be cast or otherwise formed as a unitary piece.

An inside tapered surface 78 expanding rearwardly is defined by the mandrel shell 74. The surface 78 defines a very shallow, acute angle (e.g. 15±5 degrees) relative to the tines 84 of the ferrule 82. This shallow angle arrangement causes the tines or fingers 84 effectively to bite into the outer conductor jacket of the cable as the nut 44 is tightened to the body 12 with lower tightening torques than heretofore required for effective engagement with split ring connectors, etc. The mandrel shell also defines an outer annular lip 80 which is engaged by an outer end lip 43 of the body 12 as the nut 44 is tightened onto the body 12.

The mandrel 66 further defines a splined region 72 over which the seal ring 88 will be coaxially and longitudinal aligned during attachment of the connector 10 to the cable end 54.

The ferrule 82 comprises a series of tines or fingers 84 formed by longitudinal slots in a cylindrical portion of the ferrule 82. The fingers 84 are thinned and become forced against the shallow angle inside taper surface 78 of the mandrel shell 74 as the nut 44 is tightened onto the body. The ferrule tines 84 are formed of a material which is harder than the outer metal jacket 60 of the cable end 54. Tightening of the nut 44 to the body 12 thus causes the fingers 84 to bite directly into the outer metal jacket 60 and thereby force it against the mandrel 66 in a region or band 83 thereof. A radially extended opening inside region 85 of the ferrule is for receiving the outer plastic protective sheathing 62 of the cable end 54.

The connector assembly 10 is installed after the cable end 54 is first prepared. Preparation of the cable end 54 includes removing the outer sheathing 62, outer metal jacket 60 and foam dielectric core 58 to expose a predetermined length of the center conductor 56. Then, the dielectric core 58 is further removed by a standard coring tool so that the mandrel 66 may be slipped directly under the outer metal jacket 60. The outer sheathing 62 is cut away to expose the outer surface of the metal jacket 60 for engagement by the ferrule fingers 84.

Once the cable end 54 is prepared, the connector assembly 10 is attached by slipping the nut assembly 44 over the cable end 54 until the prepared end of the cable butts up against the inside of the mandrel shell 66. The center conductor 56 will then extend about one half inch beyond the cone 64. The craftsperson is able to ascertain visually whether or not the cable end 54 is properly installed and seated in the nut assembly 44 by observing the length of the exposed center conductor 56.

To complete the installation, the center conductor 56 is then inserted into the pin chuck 31, and the nut 44 is tightened over the body 12. The inside face 53 of the nut shell 44 presses against the seal ring 88, the ferrule 82, the mandrel shell 74, mandrel 66 and cone 64 and moves them forward until the ledge 80 on the mandrel shell 74 contacts the end 43 of the body 12. The inside tapered surface 78 of the mandrel shell 74 causes the fingers 84 of the ferrule 82 to close upon and bite into and grip the outer metal jacket 60 while the inside tapered surface 65 of the cone 64 cause the tines 32 of the pin chuch 31 to bite into the center conductor 56.

Simultaneously, the seal ring 88 becomes compressed and sacrificially or permanently deformed between the inside face 53 of the nut 44 and the end 86 of the ferrule 82, i.e. once the seal ring 88 becomes deformed, it does not return to is original configuration if later removed from the connector. The seal ring 88 expands and deforms inwardly to achieve a positive environmental, long lasting, moisture impermeable seal with the outer protective sheathing 62 or outer metal conductor of the cable and results in a superior joint between the connector assembly 10 and the cable with greater axial strength associated by the deformation of the seal ring 88.

The deformation of the seal ring 88 also causes a band of the exposed inside surface of the outer metal jacket to be engaged by the splines 72 formed on the mandrel 66. These splines 72 prevent the cable 54 from rotating or twisting relative to the connector assembly 10 and thus provide a connector-to-cable joint which also strongly resists torque forces applied either to the connector 10 or to the cable.

While the instant invention has been described by reference to what is presently considered to be the most practical embodiment and best mode of practice thereof, it is to be understood that the invention may embody other widely varying forms without departing from the spirit of the invention. The presently preferred embodiment is presented as by way of illustration only and should not be construed as limiting the present invention, the scope of which is more particularly set forth in the following claims.

We claim:

1. A method for connecting to a prepared end of a coaxial cable including a center conductor, dielectric core disposed axially about the center conductor, an outer metal conductor jacket concentric with the center conductor and spaced therefrom by the dielectric core, and outer protective sheathing surrounding the outer metal jacket, the method being practiced with a threaded receiving member and a nut of a connector which is fitted onto the prepared end, and including the following steps which are simultaneously carried out as the threaded receiving member and the nut are longitudinally tightened and compressed toward each other:

inserting an annular portion of the center conductor into the threaded receiving member, engaging the nut with the threaded receiving member to cause the compression of a collet, and biting into an annular portion of the outer metal conductor jacket with at least three or more tines of the collet which is radially compressed toward an underlying mandrel within the nut upon engagement.

2. The method according to claim 1 further comprising the step of sacrificially deforming an elastomeric seal compressed between the collet and the nut to force it radially to bear against an annular region of the outer protective sheathing to cause the sheathing and the underlying region of the outer metal jacket to become compressed directly against a second, longitudinally ribbed annular region of the underlying mandrel upon the threaded engagement of the nut on the threaded receiving member.

3. A threadably tightenable coaxial cable nut connector for installation on a prepared end of a coaxial cable including a center conductor, dielectric core disposed axially about the center conductor, an outer metal conductor jacket concentric with the center conductor and spaced therefrom by the dielectic core, and an outer protective plastic sheathing surrounding the outer metal jacket, the prepared end having the outer jacket and protective sheathing trimmed to expose a length of the center conductor, the connector comprising:

a threadably tightenable nut, the nut defining an interior space including a mandrel assembly freely rotatable within the interior space until the nut is tightened upon installation; and the mandrel assembly including:

mandrel means slideably mounted under said outer metal conductor jacket and plastic sheathing ferrule means slideably mounted over said outer conductor jacket and plastic sheathing means and including collet fingers disposed over a portion of said mandrel means, said mandrel means including ferrule collet closure means for closing the collet fingers of said ferrule means to cause them to compress said outer metal conductor jacket between said portion of said mandrel means and the collet fingers as said nut is tightened during installation of said connector to said prepared cable end.

4. The coaxial cable connector set forth in claim 3 further including threaded receiving body-nut sealing means for effectuating an environmental seal when said nut is threadably tightened during installation.

5. The coaxial cable connector set forth in claim 3 wherein said ferrule collet closure means is press fit onto said mandrel means.

6. The coaxial cable connector set forth in claim 3 wherein said ferrule collet means is formed integrally with said mandrel means.

7. The coaxial cable connector set forth in claim 3 wherein said outer metal jacket, said mandrel means, and said ferrule means are substantially cylindrical and are aligned along a common longitudinal axis when the prepared cable end is inserted into the mandrel assembly of the nut, and wherein said collet closure means defines a converging inside conical closure surface which forces said collet fingers radially toward said longitudinal axis as said nut is tightened during installation.

8. The coaxial cable connector set forth in claim 7 wherein the collet fingers crimp into and deform the outer conductor jacket as the nut is threadably tightened during installation.

9. The coaxial cable connector set forth in claim 7 wherein the converging inside conical closure surface defines a shallow angle relative to the collet fingers.

10. The coaxial cable connector set forth in claim 9 wherein the shallow angle is not substantially greater than about twenty degrees.

11. The coaxial cable connector set forth in claim 3 further comprising connector to cable seal means for effectuating an environmental seal between the outer protective sheathing and the nut when it is tightened during installation of said connector.

12. The coaxial cable connector set forth in claim 11 wherein said connector to cable seal means comprises a sacrificially deformable elastometic material disposed and compressed between an interior face of said nut and said ferrule means as said nut is threadably tightened during installation.

13. The coaxial cable connector set forth in claim 12 wherein said mandrel means includes a spline region directly underlying said connector to cable seal means and causes said metal jacket to engage said spline region to prevent relative rotation of the cable and the connector after said nut has been threadably tightened during installation.

14. A coaxial cable mandrel nut connector for gripping the prepared end of a coaxial cable jacket having the center conductor exposed by the trimming of the cable jacket and any dielectric away from the center conductor, the mandrel nut connector comprising:

a nut defining an interior space including a mandrel assembly freely rotatable within the interior space until the nut is tightened upon installation;

the mandrel assembly including:

a mandrel ferrule combination, the mandrel portion slideably insertable under the cable jacket and the ferrule portion mounted over the jacket when the mandrel is slideably inserted under the cable jacket, the ferrule including fingers disposed over a portion of the mandrel; and a finger closure means for closing the fingers of the ferrule over a portion of the mandrel after insertion of the mandrel under the cable jacket, the finger closure means causes the fingers to compress and grip the jacket between the mandrel and the fingers as the nut is tightened upon installation.

15. The connector according to claim 14 further comprising sealing means for effectuating an environmental seal between the nut and the cable jacket upon installation.

16. The connector according to claim 14 wherein the ferrule has a plurality of fingers having thinned ends.

17. The connector according to claim 16 wherein the finger closure means defines a converging inside conicla closure surface which forces said fingers radially toward said longitudinal axis upon installation of the nut.

18. The connector according to claim 17 wherein the finger closure means is formed integrally with said mandrel.

19. The connector according to claim 17 wherein the plurality of fingers includes at least three fingers.

20. The connector according to claim 16 further comprising sealing means for effectuating an environmental seal between the nut and the cable jacket upon installation.

21. The connector according to claim 20 wherein the plurality of fingers includes at least three fingers.

* * * * *